United States Patent [19]

Seki et al.

[11] Patent Number: 5,024,430

[45] Date of Patent: Jun. 18, 1991

[54] PAPER HANDLING APPARATUS

[75] Inventors: Nobuyoshi Seki; Nobuyuki Morii; Yoshihide Sugiyama; Takashi Komada; Masatoshi Hosoi; Atuhisa Hujiwara; Tsutomu Ichinose, all of Nagoya; Goro Mori, Tokyo; Toshiyuki Kikuchi, Tokyo; Masahiro Minato, Tokyo, all of Japan

[73] Assignee: Ricoh Company, Ltd., Tokyo, Japan

[21] Appl. No.: 461,001

[22] Filed: Jan. 4, 1990

[30] Foreign Application Priority Data

| | | | |
|---|---|---|---|
| Jan. 18, 1989 | [JP] | Japan | 1-7601 |
| Jan. 18, 1989 | [JP] | Japan | 1-7602 |
| Jan. 18, 1989 | [JP] | Japan | 1-7603 |
| Jan. 18, 1989 | [JP] | Japan | 1-7604 |
| Jan. 18, 1989 | [JP] | Japan | 1-7605 |
| Jan. 18, 1989 | [JP] | Japan | 1-7606 |
| Jan. 18, 1989 | [JP] | Japan | 1-7607 |
| Dec. 4, 1989 | [JP] | Japan | 1-313506 |

[51] Int. Cl.[5] ..... B42B 2/00

[52] U.S. Cl. ..... 270/53; 270/58

[58] Field of Search ..... 270/37, 53, 58

[56] References Cited

FOREIGN PATENT DOCUMENTS

| | | | |
|---|---|---|---|
| 301595 | 2/1989 | European Pat. Off. | 270/53 |
| 281258 | 11/1989 | Japan | 270/53 |

*Primary Examiner*—Edward K. Look
*Assistant Examiner*—Therese M. Newholm
*Attorney, Agent, or Firm*—Oblon, Spivak, McClelland, Maier & Neustadt

[57] ABSTRACT

A paper handling apparatus having a plurality of bins and a chuck unit and a stapler which are movable along the bins and causing the stapler to bind an end portion of a stack of paper sheets which have been received from a copier or similar image forming apparatus, sorted, and then loaded on any one of the bins. The chuck unit has an upper and a lower chuck. After the stapler has bound a stack of paper sheets a push bar independent of the chucks of the chuck unit pushes the end of the stack to return it into the bin. Both the upper and lower chucks are movable up and down. The force which the chucks exert on a stack of paper sheets is controlled in matching relation to the thickness of the stack.

9 Claims, 12 Drawing Sheets

PAPER HANDLING APPARATUS

BACKGROUND OF THE INVENTION

The present invention relates to a paper handling apparatus of the type having a plurality of bins and a chuck unit and a stapler which are movable along the bins, and causing the stapler to bind an end portion of a stack of paper sheets which have been received from a copier or similar image forming apparatus, sorted, and then stacked on any one of the bins.

A copier, for example, is operable with an automatic document feeder (ADF) and a sorter which sorts a plurality of copy sheets associated with each of a plurality of documents in order of page and thereby produces a plurality of sets of copies. More specifically, while the ADF sequentially feeds the documents to a reading section of the copier in order of page, the sorter distributes the resulting copies of each document one by one to bins thereof. A paper handling apparatus capable of automatically stapling stacks of paper sheets each being distributed to respective one of bins in order of page is disclosed in Japanese Patent Laid-Open Publication (Kokai) No. 57-63561, for example. This kind of apparatus saves time and labor necessary for one to take out the stacks of copy sheets from the individual bins and staple them one by one. In the prior art apparatus, each paper stack is fully pulled out of the associated bin and transferred to an elevatable tray to be stabled there. Another paper stack to be stabled next is pulled out onto the stabled paper stack and stapled there. By such a sequence, a plurality of stapled sets of copies are piled up one upon another. While such a prior art paper handling apparatus allows the stapled copies to be readily taken out, it needs a bulky device for pulling out a paper stack onto the tray and a large exclusive space for the tray, resulting in an increase in cost and in space for installation.

In the light of the above, there has also been proposed a paper handling apparatus capable of automatically stapling paper stacks stored into successive bins without increasing the overall size of the apparatus and the space for installation. This kind of apparatus has a plurality of bins arranged one above another, and a stapler and a chuck unit which are movable up and down along the bins. Paper sheets distributed from a copier or similar image forming apparatus into each bin are gripped together by the chuck unit and then pulled out to such an extent that a portion thereof to be stapled protrude from the bin. In this condition, the end of the paper sheets is stapled and then returned to the original position on the bin. This prior art apparatus, however, has some problems left unsolved, as enumerated below. (1) Paper sheets stacked on a bin are gripped by the chuck unit, pulled out to a stapling position, stapled there, again gripped by the chuck unit, and then returned to the original position within the bin. The stapler and chuck unit, therefore, cannot be shifted to the next bin while the paper sheets are returned into the bin, slowing down the overall stapling procedure. (2) While the stapler and chuck unit are moved from one bin toward another, the chuck unit does not perform the movement for pulling out paper sheets at all. This needs a substantial period of stapling time per bin. (3) When the chuck unit chucks and pulls out paper sheets which are neatly arranged in a bin, it is apt to disturb the stack. Further, it is likely that the neatly arranged stack is disturbed by inertia when pulled out of the bin or by an impact when stopped at the stapling position.

SUMMARY OF THE INVENTION

It is an object of the present invention to provide a paper handling apparatus free from the drawbacks particular to the prior art paper handling apparatus as discussed above.

It is another object of the present invention to provide a paper handling apparatus which allows a stapler and a chuck unit to move to a particular bin while a stapled bundle is returned into its associated bin, thereby enhancing efficient stapling operations.

It is another object of the present invention to provide a paper handling apparatus which reduces the stapling time per bin and thereby promotes efficient stapling operations.

It is another object of the present invention to provide a paper handling apparatus which prevents a neat stack of paper sheets from being disturbed by inertia when pulled out of a bin by a chuck unit or when stopped at a stapling position.

It is another object of the present invention to provide a generally improved paper handling apparatus.

In accordance with the present invention, a paper handling apparatus comprises a plurality of bins arranged one above another, a paper moving device movable up and down along the bins for gripping an end of a stack of paper sheets having been received from external equipment, sorted and stacked on any one of the bins, pulling the stack out of the bin by a predetermined distance, and returning the stack into the bin, and a stapler for stapling a portion of the stack pulled out by the paper moving device which is adjacent to the end. The paper moving device comprises gripping and pulling means in the form of a pair of gripping members located one above the other for gripping the end of the stack loaded on the bin, and pushing means for pushing the end of the stack having been stapled to return the stack to an original position on the bin. The gripping and pulling means and the pushing means are provided independently of each other.

Also, in accordance with the present invention, a paper handling apparatus comprises a plurality of bins arranged one above another, a paper moving device movable up and down along the bins for gripping an end of a stack of paper sheets having been received from external equipment, sorted and stacked on any one of the plurality of bins, pulling the stack out of the bin by a predetermined distance, and returning the stack into the bin, and a stapler for stapling a portion of the stack pulled out by the paper moving device which is adjacent to the end. The paper moving device is controlled such that the paper moving device starts moving toward the bin for pulling out the stack while the paper moving device and stapler are moved from the bin having accommodated the stapled stack to another bin which is loaded with a stack of paper sheets to be stapled next.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
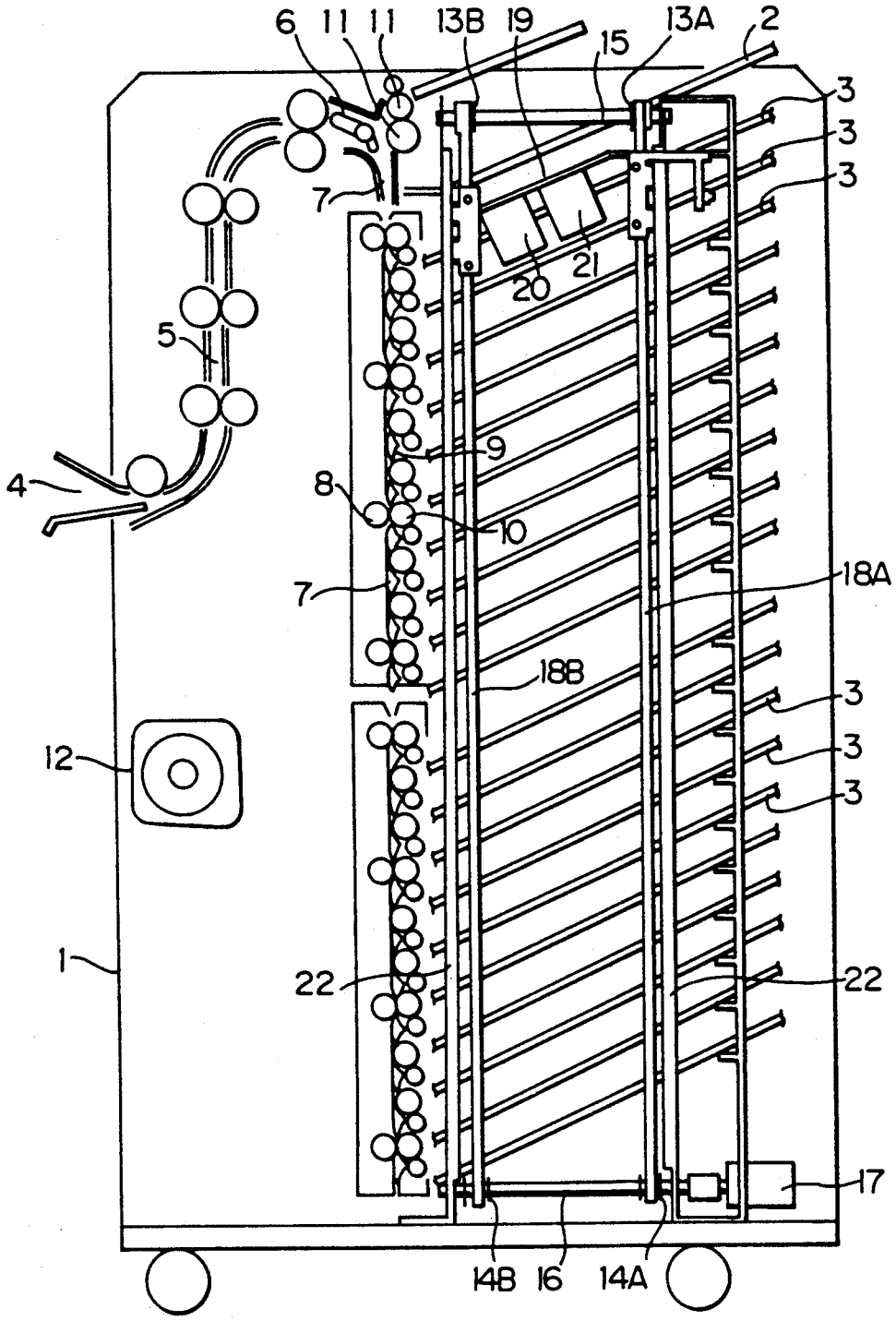
Fig. 1 PRIOR ART
FIG. 1 is a sectional side elevation schematically showing a specific construction of a prior art paper handling apparatus.

To better understand the present invention, a reference will be made to a prior art paper handling apparatus, shown in FIG. 1. The apparatus shown in FIG. 1 is implemented as the prior art apparatus disclosed in previously mentioned Japanese Patent Laid-Open Publication No. 57-63561 by way of example. As shown, the apparatus has a sorter which includes a housing 1. A discharge tray 2 is located at the uppermost position in the housing 1. A plurality of, twenty in this specific construction, bins 3 are arranged one above another at predetermined intervals below the discharge tray 2. The discharge tray 2 and bins 3 are parallel to each other and extend obliquely upward toward the outside of the housing 1. A paper transport path 5 terminates at a paper inlet 4 at which paper sheets from a copier, for example, will arrive. A selector in the form of a pawl 6 is located on the paper transport path 5 in the vicinity of the upper end of the apparatus. The selector 6 is movable to select either one of a path extending toward the discharge tray 2 and a paper transport path 7 which extends vertically along the paper inlet side of the bins 3. Transport roller pairs 8 are arranged one above another and at suitable intervals on the vertical paper transport path 7. A deflector also implemented as a pawl 9 and a discharge roller pair 10 are located in a particular position on the vertical path 7 where they face the inlet of any one of the bins 3. A discharge roller pair 11 is positioned on the path which terminates at the discharge tray 2. The transport rollers and discharge rollers mentioned above are driven by a motor 12. Shafts 15 and 16 carrying pulleys 13A and 13B and pulleys 14A and 14B, respectively, are journalled to the framework of the apparatus. The upper and lower shafts 15 and 16 are located at the front of the group of bins 3, i.e., at the viewer's side with respect to the sheet surface of FIG. 1. The pulleys 13A and 14A and the pulleys 13B and 14B are vertically aligned with each other. A motor 17 is drivably connected to the lower shaft 16. A belt 18A is passed over the aligned pulleys 13A and 14A, while a belt 18B is passed over the aligned pulleys 13B and 14B. A bracket 19 is anchored at opposite ends thereof to one run of the belts 18A and 18B which is located at the front side. The bracket 19 is inclined by the same angle as the bins 3. A stapler 20 and a chuck unit 21 are mounted on the underside of the bracket 19. Guide rollers are rollably mounted on opposite sides of the bracket 19, while channel-like guide rails 22 for guiding the guide rollers are located at the front of the bins 3. Specifically, the rollers are rollably received in the guide rails 22 which extend over substantially the entire height of the sorter.

Figure 2:
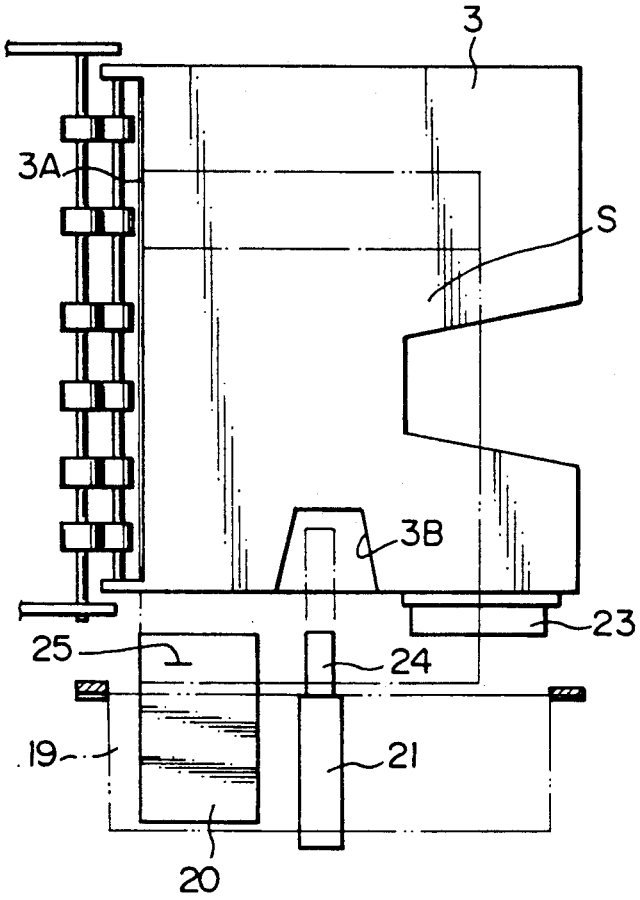
Fig.2 PRIOR ART
FIG. 2 is a plan view of a bin, a stapler and a chuck unit included in the apparatus of FIG. 1.

A paper sheet driven out of the copier and reached the paper sheet 4 advances along the paper transport path 5. When an ordinary paper discharge mode is selected, the selector 6 steers the paper sheet toward the discharge tray 2. On the other hand, when a sorter mode (sorting in order of page) or a stack mode (sorting page by page) is selected, the selector 6 steers the paper sheet to the vertical paper transport path 7. The deflectors 9 and discharge roller pairs 10 each being associated with respective one of the bins 3 are actuated in matching relation to the sorter mode or the stack mode, whereby paper sheets are distributed to the individual bins 3. As shown in FIG. 2, an abutment 3A extends upward from the paper inlet end of each bit 3, while a retractable bin fence 23 extends upright from the front end of each bin 3. Hence, paper sheets distributed to any one of the bins 3 are sequentially stacked by being abutted against the abutment 3A and bin fence 23 by the inclination of the bin and a presser, not shown.

Assume that a staple mode for stapling paper stacks loaded on the individual bins is selected. Then, as shown in FIG. 2, the motor 17 is energized to move the bracket 19 which carries the stapler 20 and chuck unit 21 therewith sequentially to the successive bins 3. After the bracket 19 has been located at any one of the bins 3, a chuck 24 included in the chuck unit 21 is extended toward the bin 3 until it reaches a notched portion 3B of the bin 3. The chuck 24 chucks the stack at the notched potion 3B and then pulls it out to a position which is indicated by a dash-and-dot line in FIG. 2. At this instant, the bin fence 23 is urged by the end of the paper stack to its retracted position. A front left portion of the paper stack having been pulled out of the pin 3 is received in a recess of the stapler 20. In response to a staple signal, a solenoid associated with the stapler 20 is energized to activate the stapler 20 so as to staple the stack at one corner 25 of the latter. Subsequently, the chuck 24 is again extended toward the bin 3 to return the stapled paper stack into the bin 3, opened to release the stack, an then retracted to a position indicated by a solid line in the figure. Thereupon, the bracket 19 is moved to another bin.

Figure 3:
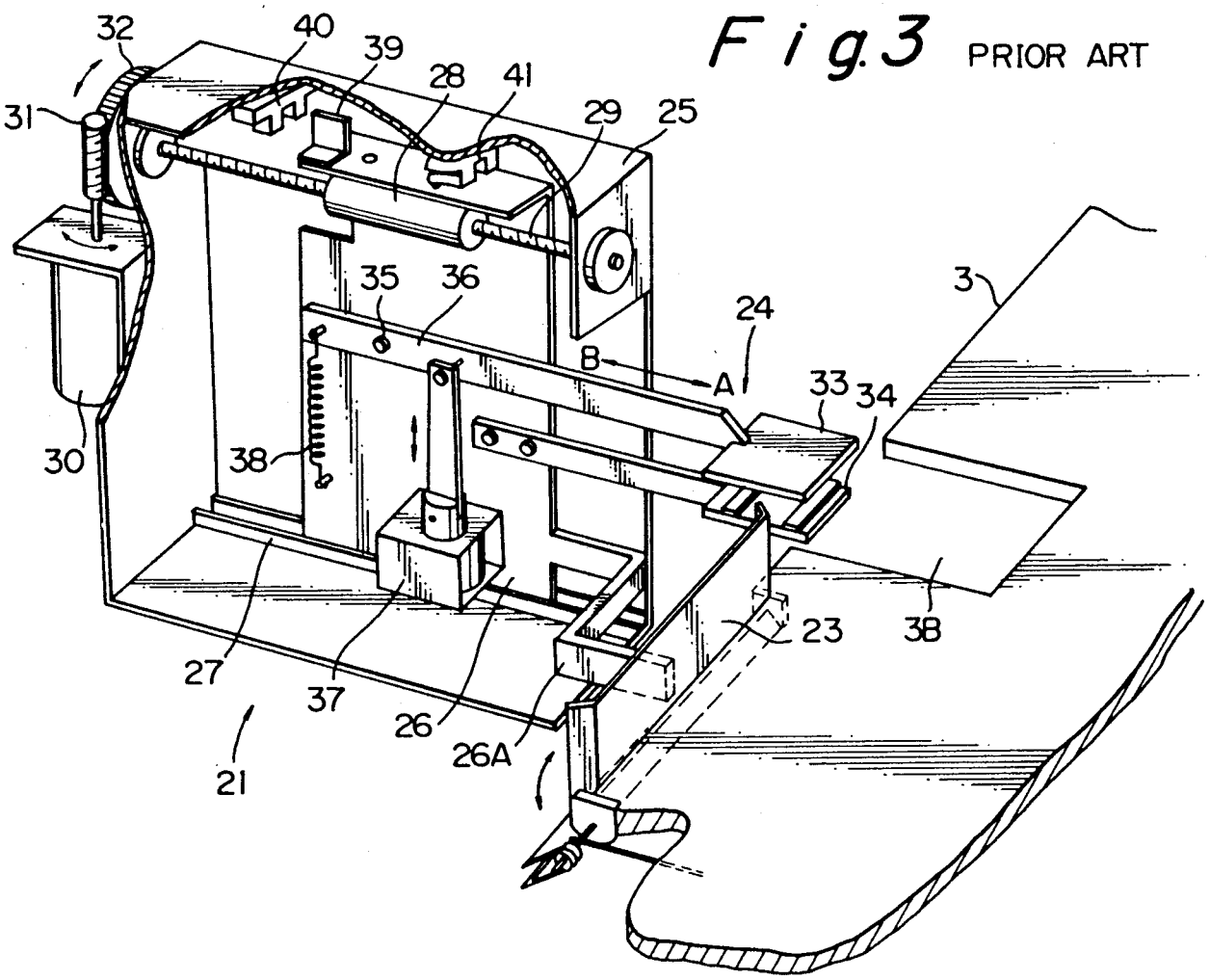
Fig. 3 PRIOR ART
FIG. 3 is a perspective view of the chuck unit of the prior art apparatus.

The chuck unit 21 is shown in detail in FIG. 3. As shown, the chuck unit 21 has a housing 25. A guide rail 27 extends in a direction AB (toward and away from the bin 3) inside the housing 25, while a movable plate 26 loaded with the chuck 24 is slidably received in the guide rail 27. The movable plate 26 has a boss 28 at the upper end thereof. A female-threaded through bore is formed throughout the boss 28. A feed screw 29 is journalled to opposite ends of the housing 25 and mated with the threaded bore of the boss 28. A motor 30 drives the feed screw 29 in either direction via a worm 31 and a worm wheel 32, whereby the plate 26 and, therefore, the chuck 24 is movable in either one of the directions A and B toward or away from the bin 3. The chuck 24 is made up of an upper chuck 33 and a lower chuck 34. The lower chuck 34 is affixed to the movable plate 26, while the upper chuck 33 is affixed to the free end of a lever 36 which is in turn rotatably mounted on the plate 26 by a pin 35. The lever 36 is connected to a solenoid 37 at a point thereof which is located at the right-hand side of the pin or fulcrum 35. A tension spring 38 is anchored at one end to the movable plate 26 and at the other end to a point of the lever 36 located at the left-hand side of the fulcrum 35, so that the lever 36 is constantly biased counterclockwise as viewed in the figure. In this configuration, when the solenoid 37 is not energized, the lever 36 is biased counterclockwise about the pin 35 by the spring 38 resulting in the coactive chucks 33 and 34 being opened. When the solenoid 37 is energized, it pulls the lever 36 clockwise to cause the chucks 33 and 34 to grip a paper stack. To stop the chuck 24 at opposite ends of its movable range, sensors 40 and 41 are mounted on the housing 25 for sensing a piece 39 which is provided on the movable plate 26. Specifically, when either one of the sensors 40 and 41 senses the piece 39, it stops the rotation of the motor 30. A tongue 26A extends out from the end of the movable plate 26 toward the bin 3. Hence, when the plate 26 slides toward the bin 3, the tongue 26A presses a portion of the bin fence 23 below an axis of rotation of the latter. This causes the bin fence 23 to fall down against the action of a spring, not shown, which constantly biases it toward the upright position. In this position, the bin fence 23 does not interfere with the movement of the paper stack. As the plate 26 slides backward away from the bin 3, the bin fence 23 will regain the upright position under the action of the spring.

A drawback with the prior art apparatus described above is that while the chuck returns a stapled paper stack to a bin, the stapler and chuck unit cannot be moved to the next bin resulting in the stapling operation being slowed down, as discussed earlier. Further, since only the upper chuck of the chuck unit is movable up and down to grip the paper stack on the bin in cooperation with the lower chuck, it is necessary that the upper surface of the lower chuck be located slightly below the upper surface of the bin so as not to contact the paper stack neatly arranged on the bin. Such a configuration brings about a problem that when the upper chuck presses the paper stack downward, the stack is urged against the upper surface of the bin before that of the lower chuck which will have been aligned with the notched portion of the bin. Then, the chuck is apt to disturb the paper stack when it is retracted while gripping the latter. To eliminate such an occurrence, upper and lower chucks each being movable up and down may be contemplated. Specifically, an arrangement may be made such that the upper and lower chucks are advanced toward the end of a paper stack and then lowered and raised, respectively, to grip the paper sheet. Such a scheme can be implemented by a simple mechanism so long as the upper and lower chucks have the same stroke. However, it is likely that when the upper and lower chucks are moved toward a bin to grip a paper stack while being opened, the lower chuck touches the paper sheets which are loaded in the underlying bin. Should the paper sheets loaded on the underlying bin have any curl, the lower chuck would dislocate them or pick them up.

To displace a member by a solenoid, it is a common practice to connect the plunger of the solenoid directly to the member of interest through a connecting piece and to anchor a spring to the member for constantly biasing the latter against the force of the solenoid. When the solenoid is energized, the member is displaced to one position by the spring while, when the former is deenergized, the latter is displaced to the other position against the action of the spring. This is also true with the above-described mechanism which moves the upper chuck 33 of the chuck unit 21 by the solenoid 37. In such a mechanism, the amount of pull of the solenoid 37 varies with the thickness of the paper stack which the chucks 33 and 34 grip. Since the force of the solenoid increases in proportion to the amount of pull of its plunger, the amount of pull and, therefore, the pulling force decreases as the paper stack grows thicker. Although the length and, therefore, tension of the spring 38 decreases with the increase in the thickness of the paper stack and thereby acts in the direction for intensifying the gripping force of the chuck 24, such an action is insignificant. Hence, when the paper stack has a substantial thickness, the gripping force which has to be strengthened is weakened so that the chuck 24 is apt to disturb the neatly arranged paper stack when it pulls it out to the stapling position.

In the prior art apparatus described above, the chuck member movable in a reciprocating motion for pulling out a paper stack from each bin to the stapling position is mounted on the base plate which is driven by the motor via the feed screw. The motor and feed screw are operatively interconnected by gears only. Assume that balls are provided on the wall of the through bore of the base plate and mated with the spiral groove of the feed screw to constitute paper moving means. This is undesirable because, when any one of the balls abuts against the end of the screw thread to stop the feed of the chuck member, the resulting impact is directly imparted to the motor to break the coil of the motor, for example.

In the chuck moving mechanism shown and described, the feed screw having a constant pitch over its entire length is mated with the female screw which is formed in the boss of the movable plate which supports the chuck, and the feed screw is rotated at a constant speed by the motor. Therefore, the chuck is moved at the same speed from the start to the end of movement. In this condition, when the chuck pulls a paper stack out of any one of the bins or stops at the stapling position while gripping the paper stack, it is apt to disturb the paper stack due to an impact ascribable to inertia.

Furthermore, the prior art apparatus is constructed such that after stapling a paper stack on a certain bin, it returns the chuck of the chuck unit to the inoperative or retracted position, moves the stapler and chuck unit to the next bin (usually a bin located just below) and stops it there, and then moves the chuck toward the bin the grip a paper stack loaded thereon. More specifically, while the stapler and chuck unit are shifted from one bin to another, the motion of the chuck for pulling out a paper stack does not occur at all. Hence, a stapling time per bin is undesirably long. A preferred embodiment of the present invention free from the above-discussed drawbacks will be described hereinafter.

In the paper handling apparatus of the present invention, the device for pulling a paper stack out of a bin to a stapling position and returning it into the bin is also mounted on the underside of a bracket which is movable up and down along a group of bins together with a stapler. Such a device stops at a bin loaded with a paper stack to be stapled, draws it out of the bin to a stapling position, and then returns the stapled paper stack into the bin.

Figure 4:
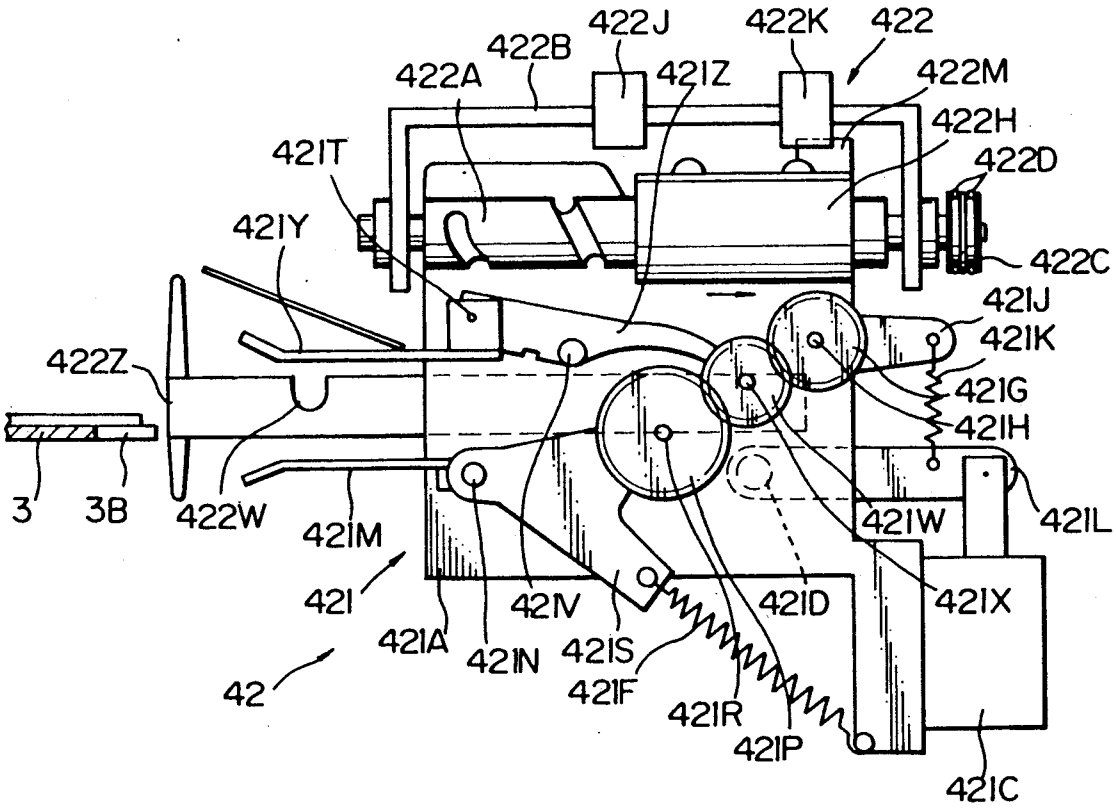
FIG. 4 is a front view of a paper moving device included in a paper handling apparatus embodying the present invention.

Referring to FIG. 4, a specific construction of the device for moving a paper stack as stated above is shown and generally designated by the reference numeral 42. The device 42 is generally made up of a chuck section 421 supported by a base plate 421A for chucking a paper stack, and a drive mechanism 422 for driving the base plate 421A in a reciprocating motion. The chuck section 421 has a pair of arms 421Z and 421S each being rotatably mounted on the base plate 421A, and a pair of chucks 421Y and 421M which are mounted on the free ends 421T and 421N of the arms 321Z and 421S, respectively. The arms 421Z and 421S are actuated by a solenoid 421C to cause the chucks 421Y and 421M to grip a paper stack. Specifically, the solenoid 421C is connected to one end of a lever 421L the other end of which is rotatably mounted on the base plate 421A at a point 421D of the latter. A lever 421J is rotatably mounted on the base plate 421A at another point 421H. A tension spring 421K is anchored at one end to the free end of the lever 421J and at the other end to a portion of the lever 421L adjacent to the free end. A B gear 421W is rigidly mounted on the arm 421Z coaxially with a fulcrum 421X about which the arm 421Z is rotatable. Likewise, a C gear 421P is rigidly mounted on the arm 421S coaxially with a fulcrum 421R about which the arm 421S is rotatable. An A gear 421G is rigidly mounted on the lever 421J coaxially with a fulcrum 421H about which the lever 421J is rotatable. The gears 421G and 421P are held in mesh with the B gear 421W. A spring 421F is preloaded between the arm 421S and the base plate 421A for constantly biasing the arm 421S counterclockwise as viewed in the figure. Hence, when the solenoid 421C is not energized, the upper and lower chucks 421Y and 421M are spaced apart from each other. The force of the tension spring 421K is selected such that the spring 421K is stretched to the maximum degree when a paper stack has the maximum allowable thickness and, in such a condition, its tension yields to the pulling force of the solenoid 421C.

Figure 5:
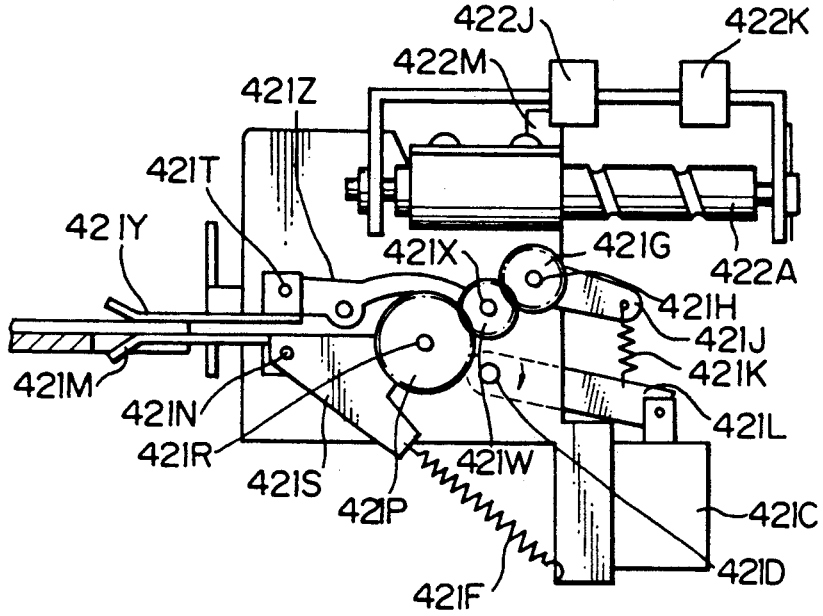
FIGS. 5 and 6 are views demonstrating the operation of a chuck unit included in the device of FIG. 4.

How the chucks 421Y and 421M grip a paper stack will be described with reference to FIG. 5.

When the solenoid 421C is energized, it rotates the lever 421L clockwise about the point 421D on the base plate 421A. Then, the lever 421J is rotated clockwise about the point 421H on the base plate 421A by the spring 421K one end of which is anchored to the lever 421L. The rotation of the lever 421J is transmitted to the lever 421Z by the intermeshing A gear 421G and B gear 421W. Specifically, the lever 421Z is rotated counterclockwise about the point 421X, i.e., downward as viewed at the point 421T, whereby the upper chuck 421Y is lowered.

When the thickness of a paper stack to be gripped by the coactive chucks 421Y and 421M is changed, the levers 421Z and 421S are rotated about the individual fulcrums to in turn rotate the lever 421J about the fulcrum 421H via the gears 421P, 421W and 421G. The force of the tension spring 421K is such that it yields to the pulling force of the solenoid 421C when the spring 421K is stretched to the maximum degree for gripping a paper stack having the maximum allowable thickness, as stated earlier. Therefore, when the lever 421J is rotated as mentioned above, only the length of the tension 421K is changed with the amount of pull of the solenoid 421C being maintained the same. In this condition, the force with which the chucks 421Y and 421M grip a paper stack is determined by the force of the tension spring 421K. As FIG. 4 indicates, as the paper stack becomes thicker, the distance between the upper and lower chucks 421Y and 421M becomes greater. This stretches the tension spring 421K and increases the tension and, therefore, the chucking force proportionately.

Since the B gear 421W is meshed with the C gear 421P, the C gear 421P is also rotated clockwise to in turn rotate the lever 421S clockwise about the fulcrum 421R. As a result, the lower chuck 421M connected to the point 421N is moved downward. Although the spring 421F constantly biases the lever 421S counterclockwise in order to open the chucks 421Y and 421M when the solenoid 421C is not energized, its preload is small enough to allow the chuck 421M to move as mentioned above. The displacements of the chucks 421Y and 421M from their predetermined positions are dependent on the numbers of teeth of the gears A, B and C and the distances between the fulcrums of rotation and the acting points.

Figure 6:
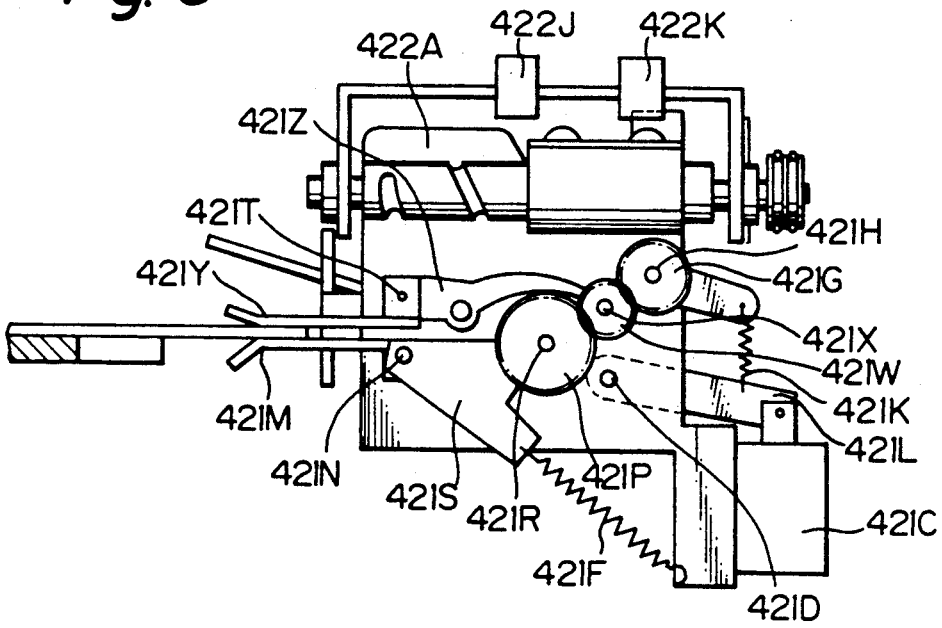

FIG. 6 shows the paper stack moving device in a condition wherein a paper stack has been gripped by the upper and lower chucks 421Y and 421M and pulled out by the drive mechanism 422 which will be described. Assume that the A gear 421G, B gear 421W and C gear 421P have forty gears, thirty-two gears, and fifty-six gears, respectively. Then, the displacements of the gears may be expressed in ratio as A:B:C=1:1.25:0.7. Further, assume that the distance between the fulcrum 421X of the lever 421Z and the acting point 421T is 52 millimeters, and the distance between the fulcrum 421R of the lever 421S and the acting point 421N is 37 millimeters. Then, the displacement ratio is $1.25\times52:0.7\times37$, i.e., 2.5:1. Specifically, when the upper chuck 421Y moves downward by 2.5, the lower chuck 421M moves upward by 1.

Figure 7:
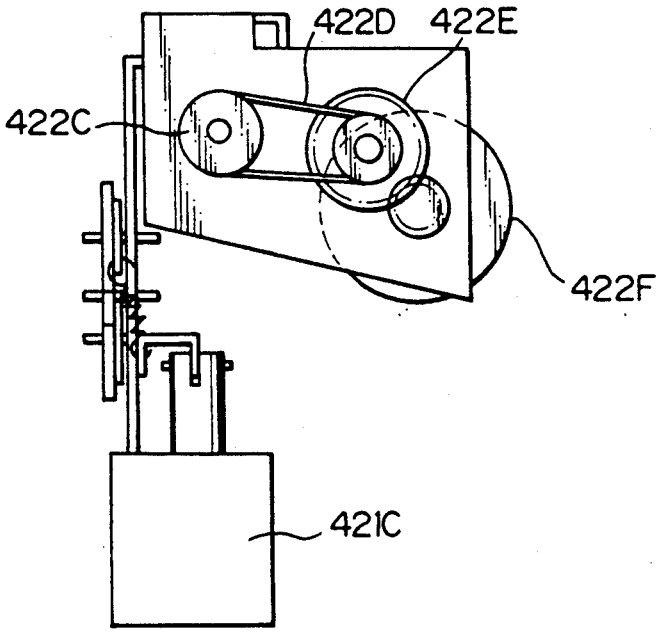
FIG. 7 is a side elevation of the illustrative embodiment.
Figure 8:
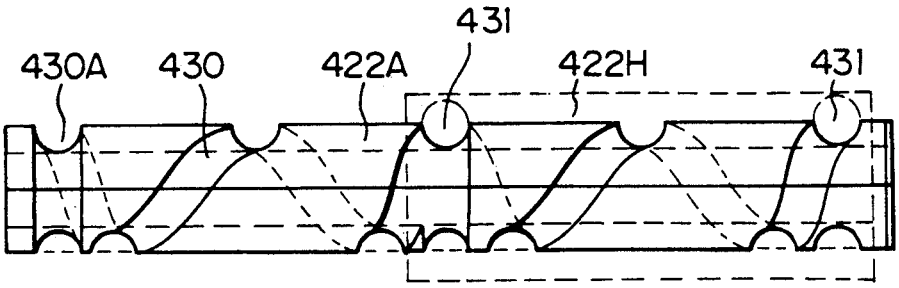
FIG. 8 is a front view of a feed shaft also included in the device of in FIG. 4.

Referring again to FIG. 4, the base plate 421A has a boss 422H which is formed with a through bore. The boss 422H constitutes the driving mechanism 422 in cooperation with a feed shaft 422A which is received in the through bore of the boss 422H. A bracket 422B configured in the form of a letter U is securely mounted on the framework of the apparatus at opposite ends thereof. The feed screw 422A is rotatably supported at opposite ends thereof by the legs of the U-shaped bracket 422B. One end of the feed shaft 422A protrudes from the bracket 422B to the outside by a predetermined amount, while a pulley 422C is mounted on the protruding end of the feed shaft 422A. As shown in FIG. 7, two belts 422D each having a circular cross-section are passed over the pulley 422C and an intermediate pulley. A motor 422F drives the pulley 422C at a constant speed via a gear 422E which is unitary with the intermediate pulley. In the illustrative embodiment, the feed shaft 422 is not configured as an ordinary feed screw. Specifically, as shown in FIG. 8, the feed shaft 422 is implemented as a cylindrical cam having a groove 430 whose pitch varies along the axis of the shaft 422. A ball 431 is provided at each of two predetermined positions on the wall of the through bore of the boss 422H. The two balls 431 are received in the groove 430 of the feed shaft 422. In this configuration, when the feed shaft 422A is rotated by the motor 422F, the displacement of the base plate 421A varies relative to the angle of rotation on the basis of the pitch of the groove 430. Sensors 422J and 422K are mounted on the framework of the apparatus for sensing a piece 422M which is provided on the base plate 421, so that the movement of the base plate 421A may be limited to a predetermined range.

Figure 9:
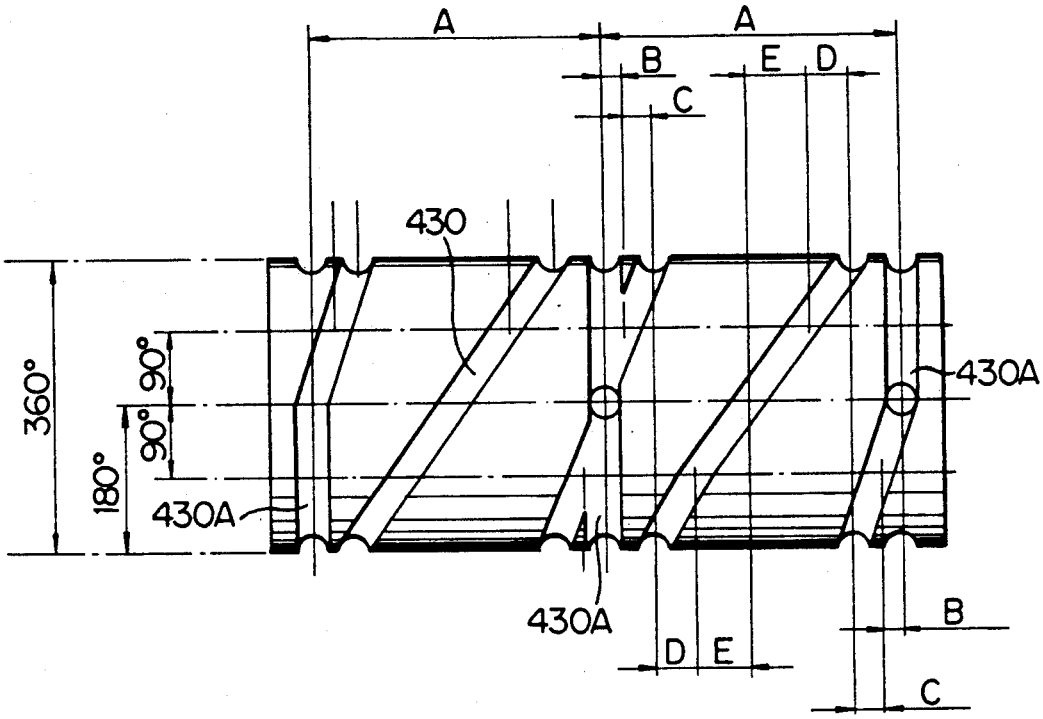
FIG. 9 is a developed view of the feed shaft shown in FIG. 8.
Figure 10:
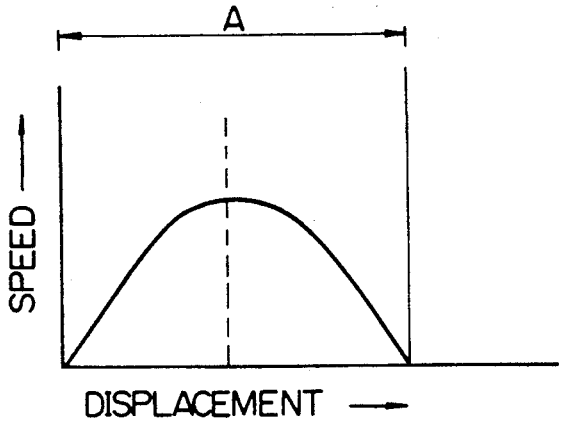
FIG. 10 is a graph showing a relationship between the amount and the speed of movement of the feed shaft.

FIG. 9 depicts a specific configuration of the groove 430 of the feed shaft 422A in a developed view. In this example, the feed shaft 422A is assumed to provide the entire displacement A by two rotations thereof (720 degrees). The movement is accelerated little by little by the first rotation of the feed shaft 422A and then decelerated by the next rotation. For example, assuming that the displacement A is 42 millimeters, the groove 430 may be configured such that the first 90 degrees of rotation provides a displacement B of 3 millimeters, another 90 degrees of rotation provides a displacement C of 4 millimeters, another 90 degrees of rotation provides a displacement D of 6 millimeters, and another 90 degrees of rotation provides a displacement E of 7 millimeters. Opposite ends of the groove 430 are configured as idle portions 430A which serve as stops. FIG. 10 indicates a relationship between the amount and the speed of movement particular to the illustrative embodiment. In FIG. 9, two identical grooves are shown in the range of 2A because two balls 431 are received in the groove 430.

When the chuck section 421 moves from a bin to the stapling position with the chucks 421Y and 421M gripping a paper sheet, the above-described speed control implemented by the groove 430 allows the paper stack to be brought to a stop accurately at a predetermined position despite the inertia particular to the start and stop of movement. Further, when either one of the balls 431 received in the groove 430 abuts against either end 430A of the groove 430, the resulting impact is absorbed by the slippage of the belts 422D and pulley 422C or that of the belts 422D and intermediate pulley. This eliminates the problem ascribable to an impact of this nature. If desired, the belts 422D having a circular cross-section may be replaced with flat belts or rectangular belts. Also, the belt and pulley type transmission may be replaced with any other type of frictional transmission.

One of characteristic features of the illustrative embodiment is exclusive means for returning a stapled paper stack into a bin which is provided in addition to the chucks. As shown in FIGS. 11 to 16, the returning means is made up of a bracket 422X securely mounted on the framework of the apparatus, a push bar 422Z slidable relative to the bracket 422X toward a bin 3, and a spring 422Y constantly biasing the push bar 422Z toward the bins 3. A pin 422S is studded on the push bar 422Z and received in a guide slot 422T which is formed through the bracket 422X. A pin 422P is studded on the bracket 422X and received in a guide slot 422P which is formed through the push bar 422Z. In this configuration, the push bar 422Z is slidable relative to the bracket 422Z in the above-mentioned direction. The spring 422Y is anchored at one end to the push bar 422Z and at the other end to the bracket 422X to bias the push bar 422Z to the left as viewed in the figures, i.e., toward the bins 3.

Figure 11:
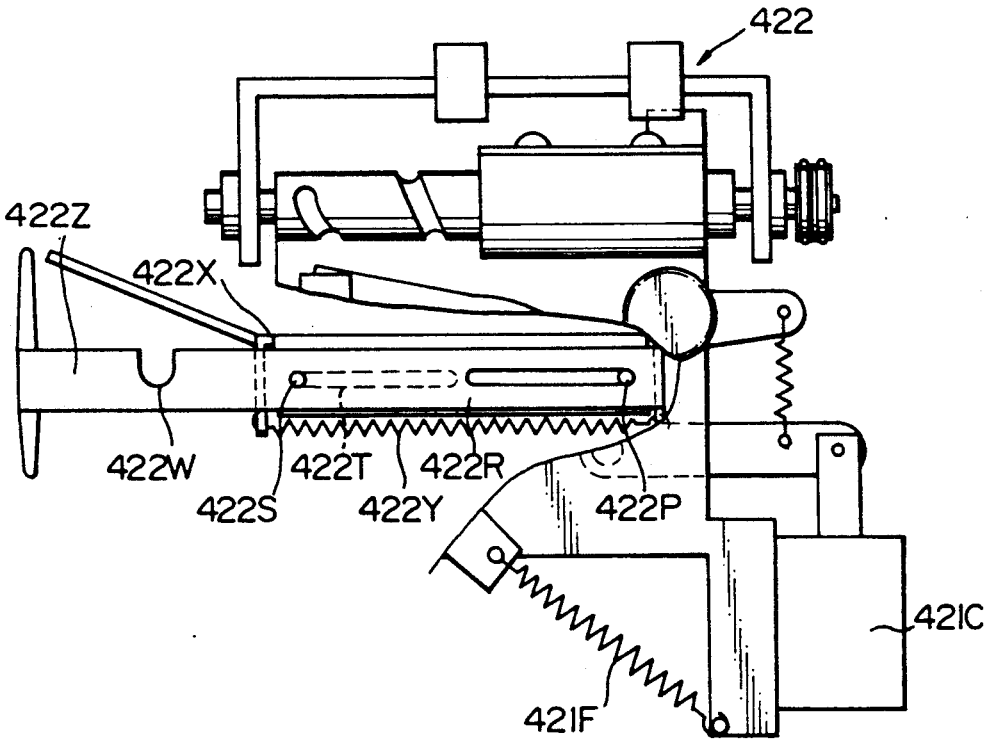
FIGS. 11 to 13 are views demonstrating the operation of returning means.
Figure 12:
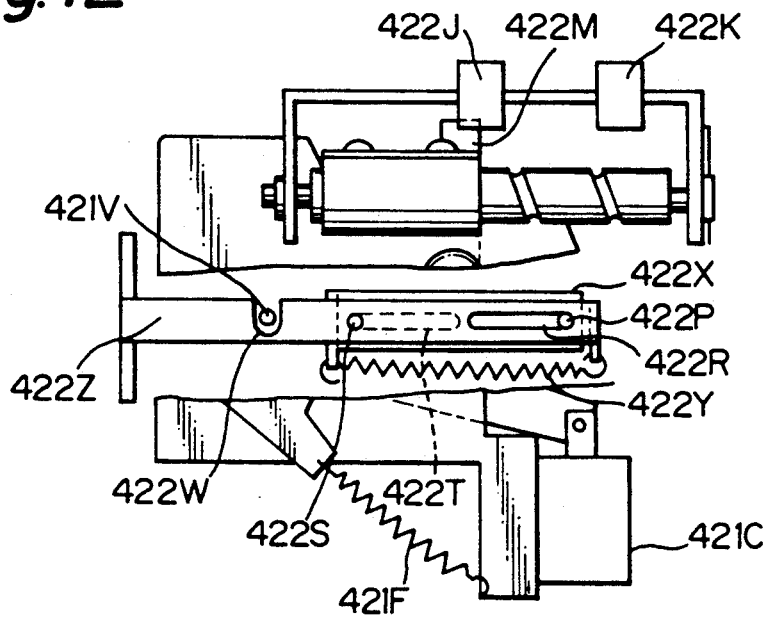
Figure 13:
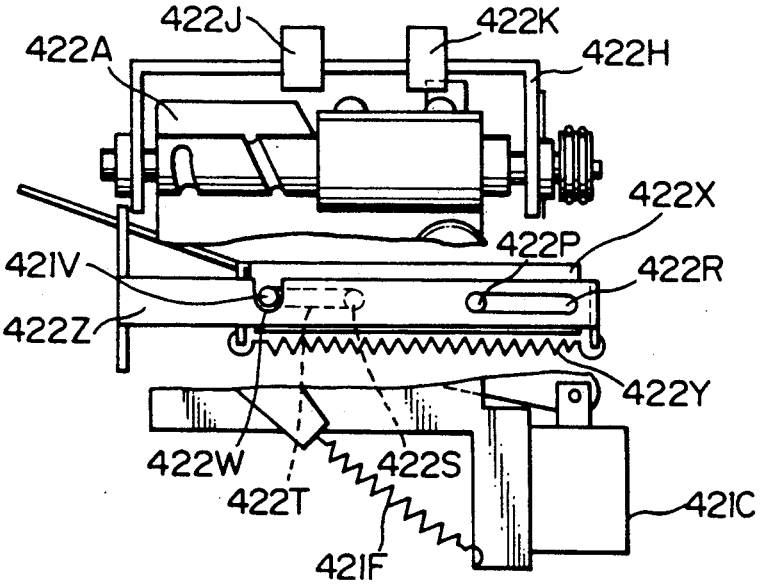

Referring to FIGS. 11 to 13, the operation of the push bar 422Z will be described. FIG. 11 shows the push bar 422Z in a condition wherein the chucks are drawn into the housing and the solenoid 421C is deenergized. As shown, the push bar 422Z is located such that its outermost end, i.e., pushing end neighbors the end of any one of the bins 3. As the base plate 421A starts moving forward and the solenoid 421C is energized to grip a paper stack on the bin 3, a pin 421V studded on the upper lever 421Z drops into a notch 422W which is provided at the upper edge of the push bar 422Z, as shown in FIG. 12. When the paper stack having been gripped by the chucks is pulled out by the operation of the motor 422, the push bar 422Z is moved backward to a position shown in FIG. 13 against the action of the spring 422Y due to the engagement of the pin 421V and notch 422W. After the paper stack has been bound by the stapler, the solenoid 421C is deenergized. Then, the upper and lower chucks are opened by the force of the spring 421F to release the paper stack. As the upper lever 421 is raised, the pin 421V is moved out of the notch 422W. Then, the push bar 422 is returned instantaneously to the position shown in FIG. 11 by the force of the spring 422Y, thereby pushing the stapled paper stack into the bin 3. The pushing end of the push bar 422Z has a vertical dimension which is greater than the distance between nearby bins 3. Hence, even when the paper stack moving device 42 is shifted to another bin 3 located just below simultaneously with the return of the paper stack to the overlying bin 3, the pushing end of the push bar 422Z will abut against the end of the paper stack associated with the overlying bin 3 and will thereby surely return it into the bin 3.

Figure 14:
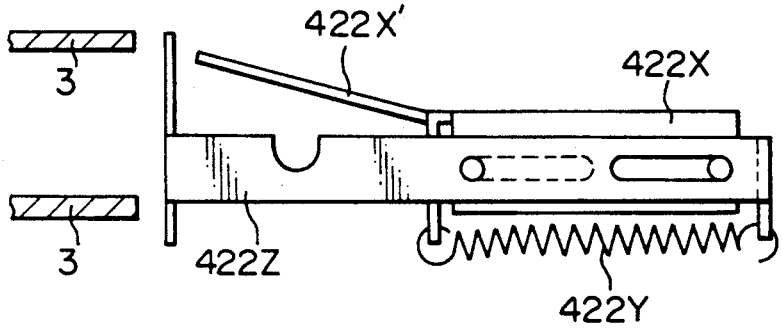
FIG. 14 is a view showing a specific construction of the returning means.
Figure 15:
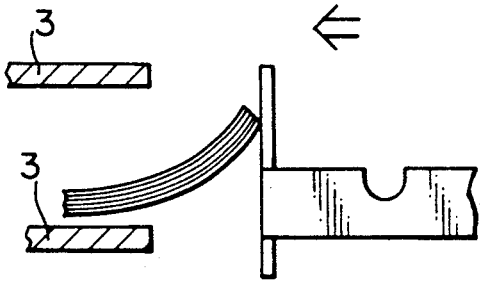
FIG. 15 is a view useful for understanding a problem of the returning means.

FIG. 14 shows the push bar 422Z, bracket 422X and spring 422Y only. As shown, the vertical dimension of the pushing end of the push bar 422Z is greater than the distance between nearby bins 3 for the above-stated purpose. Since each bin 3 has the notched portion 3B (FIG. 2) as stated previously, the pushing end of the push bar 422Z is prevented from interfering with the bin 3 when the push bar 422Z has returned a paper stack into the bin 3. As shown in FIG. 14, a guide member 422X' extends obliquely upward toward the bins 3 from the end of the bracket 422X. The tip of the guide member 422X' is located at a lower level than the upper edge of the pushing end of the push bar 422Z. The guide member 422X' effectively eliminates an occurrence that extremely soft paper sheets or upwardly curled paper sheets slide upward along the pressing end of the push bar 422Z and beyond the upper edge of the latter when pushed toward the bin 3.

After the stapler has bound a paper stack loaded on a certain bin 3, the stapler and the paper moving device are shifted to another bin loaded with a paper stack to be bound next (usually a bin located just below) as will be described hereinafter with reference to flowcharts and a timing chart.

Figure 16A:
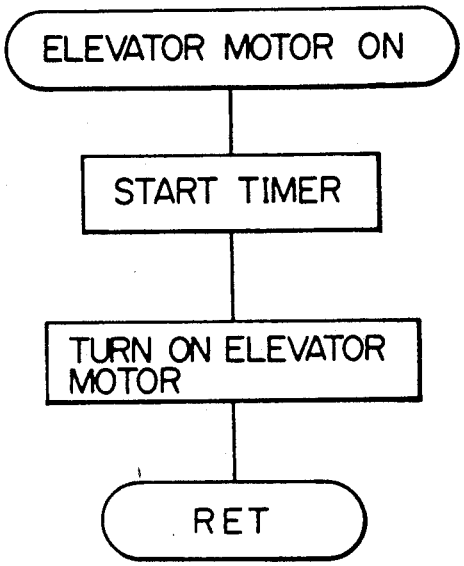
FIGS. 16A and 16B are flowcharts showing an elevator motor ON procedure and a chuck forward start procedure, respectively.
Figure 16B:
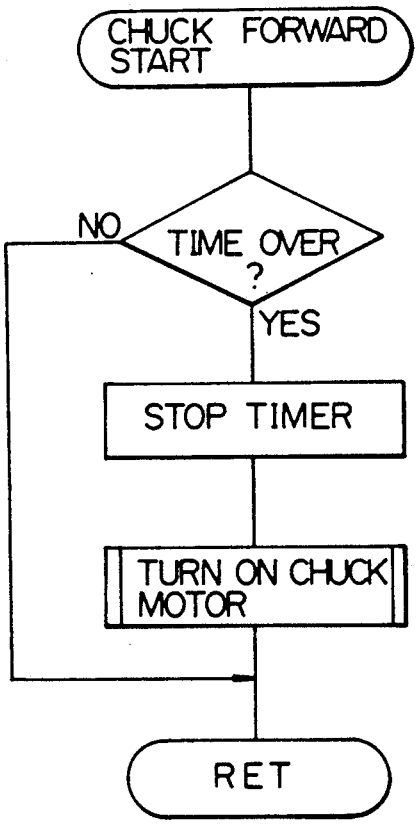
Figure 17:
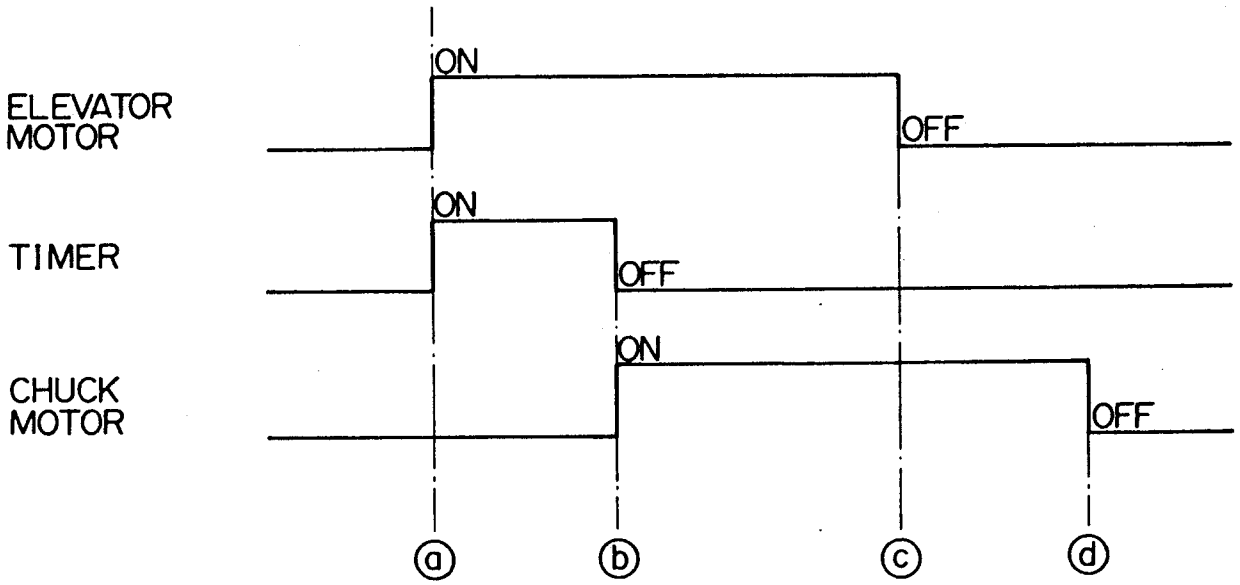
FIG. 17 is a timing chart associated with the flowcharts.

An elevator motor for moving the stapler 20 and paper moving device 42 up and down (17, FIG. 1) is turned on while a timer is started (FIG. 16A and time a, FIG. 17). The timer is loaded with a predetermined period of time beforehand. When the predetermined period of time expires (time b, FIG. 17), the timer is stopped and the chuck motor 422F is turned on to move the chuck unit 421 forward. The elevator motor is deenergized when the stapler 20 and paper moving device 42 has arrived at the next bin (time c, FIG. 17). At this instant, the tips of the chucks 421Y and 421M have already arrived at a position close to the end of a paper stack loaded on the next bin. The chuck motor 422F is further rotated until the chucks 421Y and 421M reach a position where they can readily grip the paper stack (time d, FIG. 17). If the chucks arrive at the gripping position at the time c, the lower chuck 421M is apt to disturb the neatly arranged paper stack. Specifically, the time set in the timer is selected to be shorter than the interval between the start of movement of the stapler and paper moving device away from the previous bin and the stop of the same at the next bin by a period of time necessary for the chuck started from its predetermined position to reach a position adjacent to the end of a bin. Then, when the stapler and paper moving device are brought to a stop at the next bin, the end of the chuck will have been positioned near the end of the bin. This successfully reduces the stapling time as far as possible.

In summary, in accordance with the present invention, a stapled paper stack is returned to its associated bin not by a chuck but by an exclusive push bar. This allows a paper moving device and a stapler to be shifted to another bin simultaneously with the return of the stapled paper stack into the bin. Hence, all the paper stacks loaded on individual bins can be bound within a short period of time, enhancing efficient stapling operation. Since an upper and a lower gripping member are movable up and down, they surely grip a paper stack on a bin and pull it out smoothly. The displacement of the lower gripping member is comparatively small and, therefore, will not touch or pick up a paper stack loaded on another bin located just below even if the paper stack has been curled. An increase in the thickness of a paper stack is coped with by an increase in the gripping force, so that a neatly arranged paper stack is prevented from being disturbed. A feed screw forming part of paper pulling means has a groove whose pitch is smaller at opposite end portions of a movable range than at an intermediate portion. With such a groove configuration, it is possible to reduce the acceleration at the time of starts and stops and thereby to reduce impacts ascribable to stops of the chuck members. Such impacts would otherwise effect a motor. Moreover, after a paper stack loaded in a certain bin has been stapled, the chuck can grip a paper stack of the next bin within a short period of time. This further promotes rapid stapling operations with all the bins and thereby enhances efficient operations.

Various modifications will become possible for those skilled in the art after receiving the teachings of the present disclosure without departing from the scope thereof.

What is claimed is:

1. A paper handling apparatus comprising:

a plurality of bins arranged one above another;

paper moving means movable up and down along said plurality of bins for gripping an end of a stack of paper sheets having been received from external equipment, sorted and stacked on any one of said plurality of bins, pulling said stack out of said bin by a predetermined distance, and returning said stack into said bin; and stapling means for stapling a portion of said stack pulled out by said paper moving means which is adjacent to said end;

said paper moving means comprising:

gripping and pulling means comprising a pair of gripping members located one above the other for gripping the end of the stack loaded on said bin; and pushing means for pushing the end of the stack having been stapled to return said stack to an original position on said bin;

said gripping and pulling means and said pushing means being provided independently of each other.

2. An apparatus as claimed in claim 1, wherein said pushing means comprises:

a member for pushing the end of the stack toward said bin; and a spring constantly biasing said member toward said bin;

said spring accumulating a force while said gripping and pulling means is moved to pull out the stack;

said spring releasing said force at a predetermined timing in interlocked relation to release of the stack from said gripping and pulling means.

3. An apparatus as claimed in claim 1, further comprising a guide member fixed at one end to an end portion of a framework of said paper moving means which faces said bin and extending to neighborhood of an end of said bin, said guide member having a guide surface located at a lower level than an upper edge of a pushing portion of said pushing means for guiding an upper surface of the stack.

4. An apparatus as claimed in claim 1, wherein a displacement of upper one of said pair of gripping members is greater than a displacement of lower one of said pair of gripping members.

5. An apparatus as claimed in claim 1, further comprising:

a solenoid for providing said pair of gripping members with a gripping force; and a tension spring preloaded between said solenoid and said pair of gripping members;

said spring exerting, when stretched with said pair of gripping members gripping a stack of paper sheets having a maximum allowable thickness, a tension which yields to a pulling force of said solenoid.

6. An apparatus as claimed in claim 1, wherein said gripping and pulling means comprises:

a drive source;

a feed shaft driven by said drive source and extending in an intended direction of movement of the stack, said feed shaft having a spiral groove on outer periphery;

a member comprising a through bore through which said feed shaft extends and an engaging member provided on a wall of said through bore and mated with said spiral groove of said feed shaft, said member further comprising a pair of gripping members for gripping the stack of paper sheets; and frictional interengaging means interposed between said feed shaft and said drive source for power transmission.

7. An apparatus as claimed in claim 6, wherein said drive source comprises a motor rotatable at a constant speed.

8. An apparatus as claimed in claim 7, wherein said spiral groove of said feed shaft has a smaller pitch at opposite end portions of a movable range of said member having said pair of gripping members than at an intermediate portion of said movable range.

9. A paper handling apparatus comprising:

a plurality of bins arranged one above another;

paper moving means movable up and down along said plurality of bins for gripping an end of a stack of paper sheets having been received from external equipment, sorted and stacked on any one of said plurality of bins, pulling said stack out of said bin by a predetermined distance, and returning said stack into said bin; and stapling means for stapling a portion of said stack pulled out by said paper moving means which is adjacent to said end;

said paper moving means being controlled such that said paper moving horizontally means starts moving toward said bin for pulling out the stack while said paper moving means and said stapling means are moved from said bin having accommodated the stapled stack to another bin which is loaded with a stack of paper sheets to be stapled next.

* * * * *